US011834925B2

(12) United States Patent
Alamer et al.

(10) Patent No.: US 11,834,925 B2
(45) Date of Patent: Dec. 5, 2023

(54) WELLHEAD-SIDE-OUTLET CONTINGENCY VALVE REMOVAL PLUG ADAPTOR ASSEMBLY

(71) Applicant: SAUDI ARABIAN OIL COMPANY, Dhahran (SA)

(72) Inventors: Mansour Abdullah Alamer, Dammam (SA); Mohammed Eid Almukhlifi, Ad Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/453,255

(22) Filed: Nov. 2, 2021

(65) Prior Publication Data

US 2023/0133486 A1 May 4, 2023

(51) Int. Cl.
*E21B 34/02* (2006.01)
*E21B 1/22* (2006.01)
*E21B 33/068* (2006.01)

(52) U.S. Cl.
CPC ..... *E21B 34/02* (2013.01); *E21B 1/22* (2020.05); *E21B 33/068* (2013.01); *E21B 2200/06* (2020.05)

(58) Field of Classification Search
CPC ..... E21B 34/02; E21B 19/22; E21B 33/068; E21B 2200/06
USPC ..... 166/91.1
See application file for complete search history.

(56) References Cited

U.S. PATENT DOCUMENTS

| | | | | |
|---|---|---|---|---|
| 5,927,405 | A * | 7/1999 | Monjure | E21B 23/14 166/77.2 |
| 6,186,239 | B1 | 2/2001 | Monjure et al. | |
| 8,181,700 | B2 | 5/2012 | Baugh | |
| 8,899,254 | B1 | 12/2014 | Weiler | |
| 9,217,322 | B2 * | 12/2015 | Kleppa | E21B 34/02 |
| 10,502,021 | B2 | 12/2019 | Healy | |
| 2002/0017384 | A1 * | 2/2002 | Ostocke | E21B 34/02 166/85.1 |
| 2011/0108275 | A1 | 5/2011 | Borak et al. | |
| 2019/0277137 | A1 * | 9/2019 | Gray | E21B 49/086 |

* cited by examiner

*Primary Examiner* — Matthew R Buck
*Assistant Examiner* — Patrick F Lambe
(74) *Attorney, Agent, or Firm* — Osha Bergman Watanabe & Burton LLP

(57) ABSTRACT

A side-outlet adaptor assembly for repairing a side-outlet of a wellhead spool is disclosed. The side-outlet adaptor assembly includes an isolation sleeve having a first portion adapted to be received by the side-outlet and a second portion adapted to be received by an adaptor, the adaptor having a wellhead-side opening adapted to receive the isolation sleeve and a gate-valve-side (GV-side) opening adapted to receive a valve replacement (VR) plug, and a test port arranged on the adaptor for performing a pressure test of the side-outlet.

15 Claims, 6 Drawing Sheets

WELLHEAD-SIDE-OUTLET CONTINGENCY VALVE REMOVAL PLUG ADAPTOR ASSEMBLY

BACKGROUND

In the oil and gas industry, a wellhead includes all permanent equipment between the uppermost portion of the surface casing and the tubing head adaptor connection. A conventional surface wellhead configuration consists of a casing head housing, casing head spool(s), tubing head spool, tubing bonnet and a production tree, which are installed in stages during the drilling phase of a well. A key function of a wellhead is to suspend the casing load at the surface and seal the annuli between the large casings and the small casings. The wellhead spools (i.e., casing head spool, tubing head spool) are wellhead components to secure the upper end of respective casing/tubing strings. Additionally, a wellhead spool may contain a side-outlet to facilitate the installation of a gate valve (GV) or blind flange to monitor a corresponding annulus and enable future interventions if required.

Wellhead-side-outlets usually include a special threaded profile to accommodate for installing a valve removal (VR) plug. VR plugs are threaded plugs that can be installed in the wellhead to provide a mechanical barrier to isolate the annulus pressure in order to safely replace a damaged gate valve. The specifications of the plug and threaded profile are defined by the American Petroleum Institute (API) SPEC 6A standard. The threaded profile of the side-outlet and the matching profile of the VR plug are referred to as the VR plug profile. If the VR plug profile on the side-outlet becomes damaged, complex operations are required in order to safely repair the damage, e.g., critical operations are required in order to repair and re-machine (i.e., a heat source) the profile near a hazardous zone with no guarantee of success.

SUMMARY

In general, in one aspect, the invention relates to a side-outlet adaptor assembly for repairing a side-outlet of a wellhead spool. The side-outlet adaptor assembly includes an isolation sleeve having a first portion adapted to be received by the side-outlet and a second portion adapted to be received by an adaptor, the adaptor having a wellhead-side opening adapted to receive the isolation sleeve and a gate-valve-side (GV-side) opening adapted to receive a valve replacement (VR) plug, and a test port arranged on the adaptor for performing a pressure test of the side-outlet.

In general, in one aspect, the invention relates to a wellhead of a well. The wellhead includes a wellhead spool comprising a side-outlet that is damaged, and a side-outlet adaptor assembly for repairing the side-outlet. The side-outlet adaptor assembly includes an isolation sleeve having a first portion adapted to be received by the side-outlet and a second portion adapted to be received by an adaptor, the adaptor having a wellhead-side opening adapted to receive the isolation sleeve and a gate-valve-side (GV-side) opening adapted to receive a valve replacement (VR) plug, and a test port arranged on the adaptor for performing a pressure test of the side-outlet.

In general, in one aspect, the invention relates to a method for repairing a side-outlet of a wellhead. The method includes identifying a damaged valve removal (VR) plug profile on the side-outlet of the wellhead, inserting an isolation sleeve of a side-outlet adaptor assembly into the damaged VR plug profile, installing a ring gasket on a ring groove surrounding the side-outlet, installing an adaptor of the side-outlet adaptor assembly using the isolation sleeve and the ring gasket, inserting a VR plug onto a VR plug profile of the adaptor, and confirming air/gas tightness of the side-outlet by applying pressure through a test port of the adaptor to detect any air/gas leakage from an annulus to outside of the wellhead, wherein the damaged VR plug profile is substituted by the VR plug profile of the adaptor.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1A:
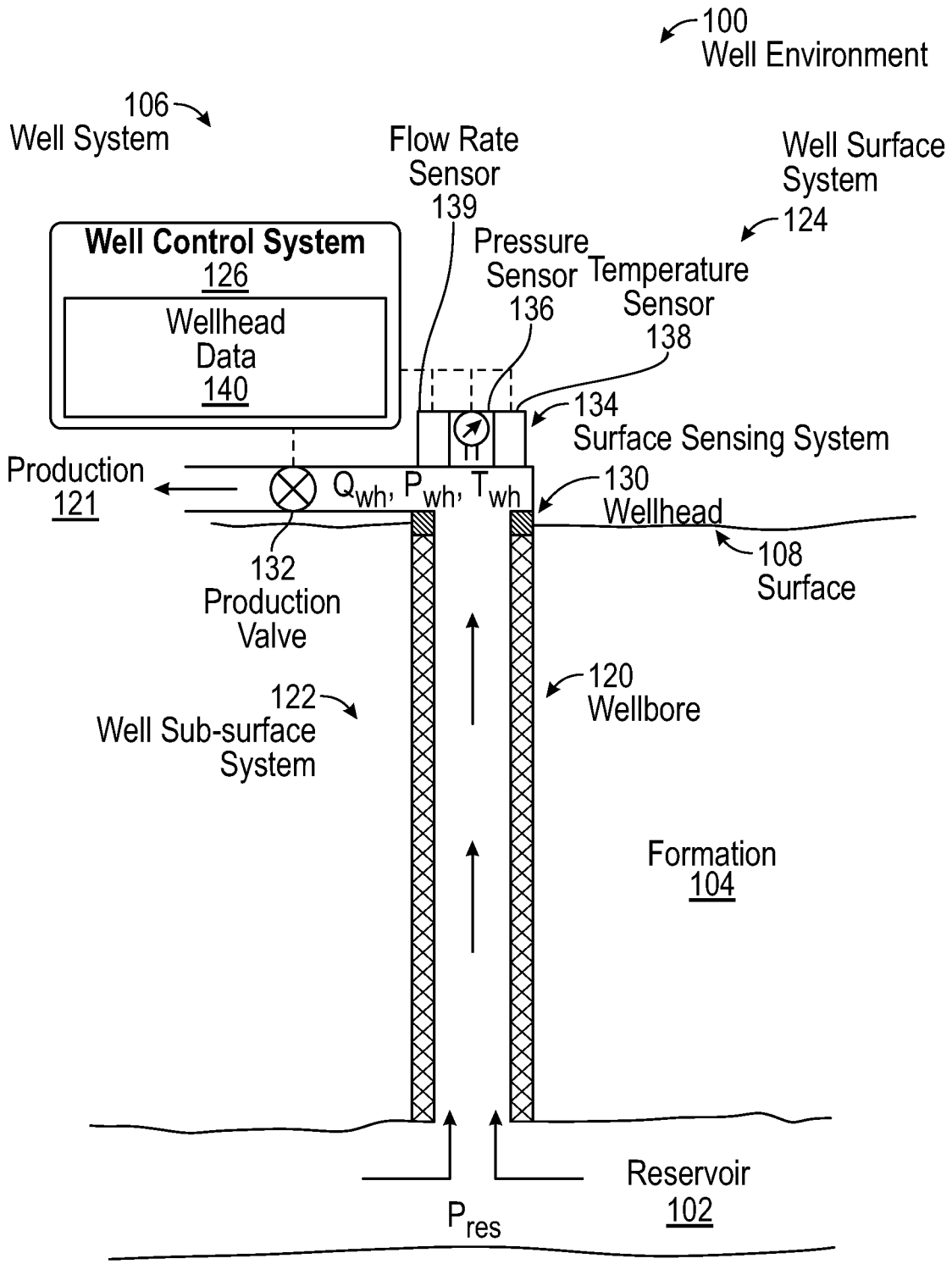
FIGS. 1A, 1B, 1C, 1D, 1E, and 1F show a system in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of the invention provide a method, a system, and a wellhead-side-outlet adaptor assembly. The wellhead-side-outlet adaptor assembly includes two separate components, i.e., an adaptor with a valve removal (VR) plug profile and an isolation sleeve that allows for pressure testing the connection between the adaptor and the installed wellhead-side-outlet with a damaged VR plug profile. The wellhead-side-outlet adaptor assembly is used to provide a seal on the damaged area in the side-outlet of the existing wellhead spool while allowing for the installation of a VR plug on a new profile to facilitate future side-outlet valve replacement.

FIG. 1A shows a schematic diagram in accordance with one or more embodiments. In one or more embodiments, one or more of the modules and/or elements shown in FIG. 1A may be omitted, repeated, and/or substituted. Accordingly, embodiments of the invention should not be considered limited to the specific arrangements of modules and/or elements shown in FIG. 1A.

FIG. 1A illustrates a well environment (100) that includes a hydrocarbon reservoir ("reservoir") (102) located in a subsurface formation ("formation") (104) and a well system (106). The formation (104) may include a porous formation that resides underground, beneath the Earth's surface ("surface") (108). In the case of the well system (106) being a hydrocarbon well, the reservoir (102) may include a portion of the formation (104). The formation (104) and the reservoir (102) may include different layers of rock having varying characteristics, such as varying degrees of permeability, porosity, capillary pressure, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system ("control system") (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of computer system (400) described below in FIGS. 4A and 4B and the accompanying description.

The wellbore (120) may include a bored hole that extends from the surface (108) into a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "down-hole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the formation (104) or the reservoir (102) during injection operations, or the communication of monitoring devices (e.g., logging tools) into the formation (104) or the reservoir (102) during monitoring operations (e.g., during in situ logging operations).

In some embodiments, during operation of the well system (106), the control system (126) collects and records wellhead data (140) for the well system (106). The wellhead data (140) may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well (106), and water cut data. In some embodiments, the measurements are recorded in real-time, and are available for review or use within seconds, minutes, or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well (106) to assess a relatively current state of the well system (106), and make real-time decisions regarding development of the well system (106) and the reservoir (102), such as on-demand adjustments in regulation of production flow from the well.

In some embodiments, the well sub-surface system (122) includes casing installed in the wellbore (120). For example, the wellbore (120) may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In embodiments having a casing, the casing defines a central passage that provides a conduit for the transport of tools and substances through the wellbore (120). For example, the central passage may provide a conduit for lowering logging tools into the wellbore (120), a conduit for the flow of production (121) (e.g., oil and gas) from the reservoir (102) to the surface (108), or a conduit for the flow of injection substances (e.g., water) from the surface (108) into the formation (104). In some embodiments, the well sub-surface system (122) includes production tubing installed in the wellbore (120). The production tubing may provide a conduit for the transport of tools and substances through the wellbore (120). The production tubing may, for example, be disposed inside casing. In such an embodiment, the production tubing may provide a conduit for some or all of the production (121) (e.g., oil and gas) passing through the wellbore (120) and the casing.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures (called "wellhead casing hanger" for casing and "tubing hanger" for production tubing) for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (121). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

In some embodiments, the wellhead (130) includes a choke assembly. For example, the choke assembly may include hardware with functionality for opening and closing the fluid flow through pipes in the well system (106). Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system (126). Accordingly, a well control system (126) may obtain wellhead data regarding the choke assembly as well as transmit one or more commands to components within the choke assembly in order to adjust one or more choke assembly parameters.

Keeping with FIG. 1A, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (121) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (121) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" ($T_{wh}$). In some embodiments, the surface sensing system (134) includes a flow rate sensor (139) operable to sense the flow rate of production (121) flowing through the well surface system (124), after it exits the wellbore (120). The flow rate sensor (139) may include hardware that senses a flow rate of production (121) ($Q_{wh}$) passing through the wellhead (130).

Figure 1B:
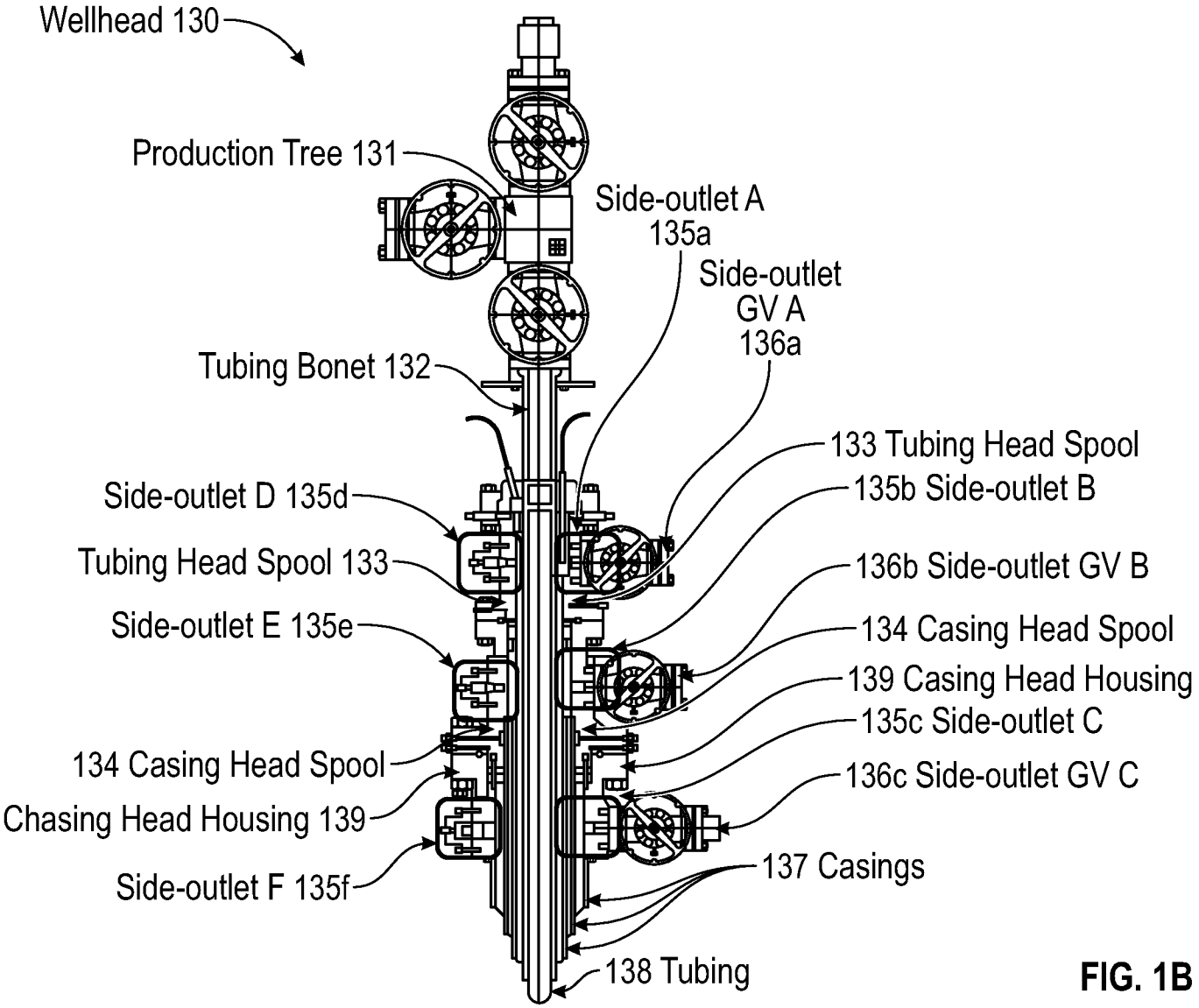

Turning to FIG. 1B, FIG. 1B shows a schematic diagram in accordance with one or more embodiments. In one or more embodiments, one or more of the modules and/or elements shown in FIG. 1B may be omitted, repeated, and/or substituted. Accordingly, embodiments of the invention should not be considered limited to the specific arrangements of modules and/or elements shown in FIG. 1B.

FIG. 1B illustrates details of the wellhead (130) depicted in FIG. 1A above. As shown in FIG. 1B, the wellhead (130) includes a production tree (131) with concentric casings (137), a tubing (138), and associated equipment such as a casing head housing (139), a tubing bonnet (132), wellhead spools (e.g., tubing spool (133), casing spool (134)), and associated side-outlets (i.e., side-outlet A (135*a*), side-outlet B (135*b*), side-outlet C (135*c*), side-outlet D (135*d*), side-outlet E (135*e*), side-outlet F (1350). In addition, wellhead-side-outlet gate valves (GVs) (i.e., side-outlet GV A (136*a*), side-outlet GV B (136*b*), side-outlet GV C (136*c*)) are installed on some of the side-outlets. Each of the casing head housing (139), tubing spool (133), and casing spool (134) forms a flange surrounding the casings (137) and tubing (138). An example cross-section of the flange is shown in FIG. 1C below.

Figure 1C:
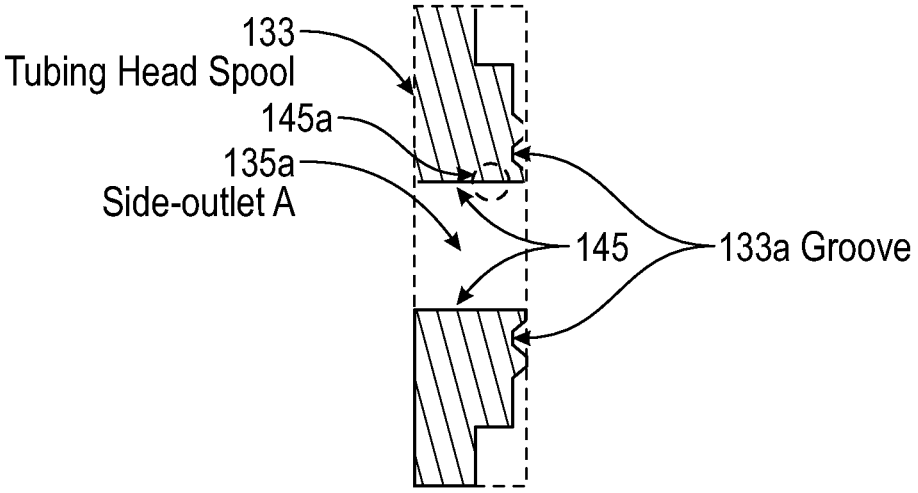
Figure 1D:
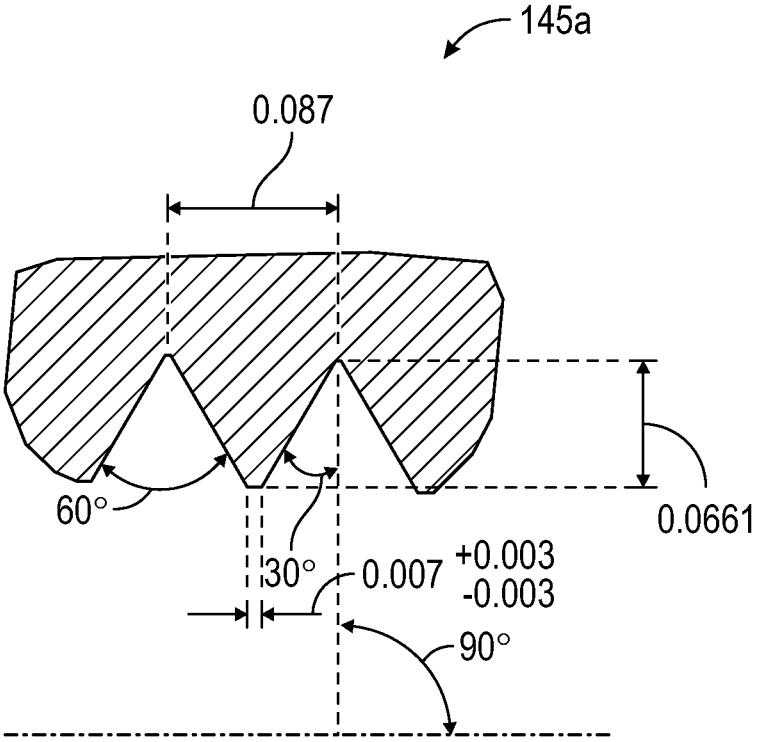

FIG. 1C illustrates one side of a cross-section of the tubing head spool (133) where the side-outlet A (135*a*) is formed, as depicted in FIG. 1B above. The side-outlet A (135*a*) is an opening in the tubing head spool (133) where the surface (145) of the opening is the VR plug profile (145). For example, the VR plug profile (145) may be a threaded surface adapted to accept a gate valve (e.g., side-outlet GV A (136*a*)), as defined based on the API SPEC 6A standard. In particular, the API SPEC 6A standard defines geometrical attributes of the threaded surface including the helical rib forming a screw thread, which are not explicitly shown in FIG. 1C for simplicity. Separately, a cross-section view of an example portion (145*a*) of the helical rib on the threaded surface based on the API SPEC 6A standard is shown in FIG. 1D below. In one or more embodiments of the invention, a continuous groove (133*a*) is formed in the tubing head spool (133) to surround the opening of the side-outlet A (135*a*) at the exterior surface of the tubing head spool (133). In some embodiments, multiple concentric continuous grooves may exist. The continuous groove (133*a*) may form a circle or other suitable shape surrounding the opening of the side-outlet A (135*a*). In one or more embodiments of the invention, the continuous groove (133*a*) is adapted to receive a ring gasket to provide a seal for the side-outlet adaptor assembly described in reference to FIGS. 1E and 1F below. In this context, the continuous groove (133*a*) is referred to as a ring groove. Ring gaskets are typically made from metallic components such as carbon steel, stainless steel, or other corrosion resistance alloys. Ring gaskets are installed between two wellhead components to provide metal-to-metal sealing at the connection, such as sealing at the connection between the VR plug adaptor assembly and the wellhead side-outlet connection.

Figure 1E:
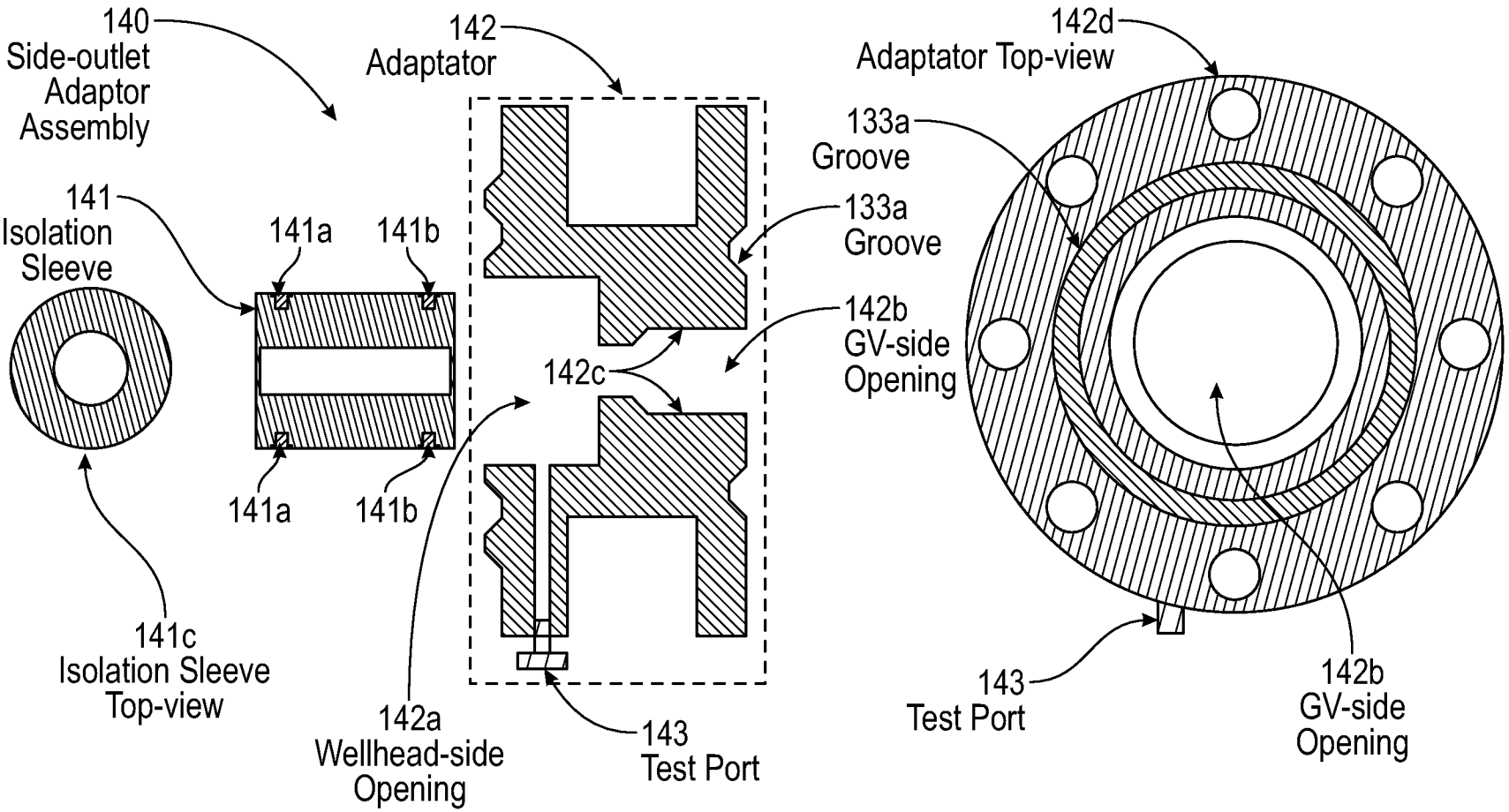
Figure 1F:
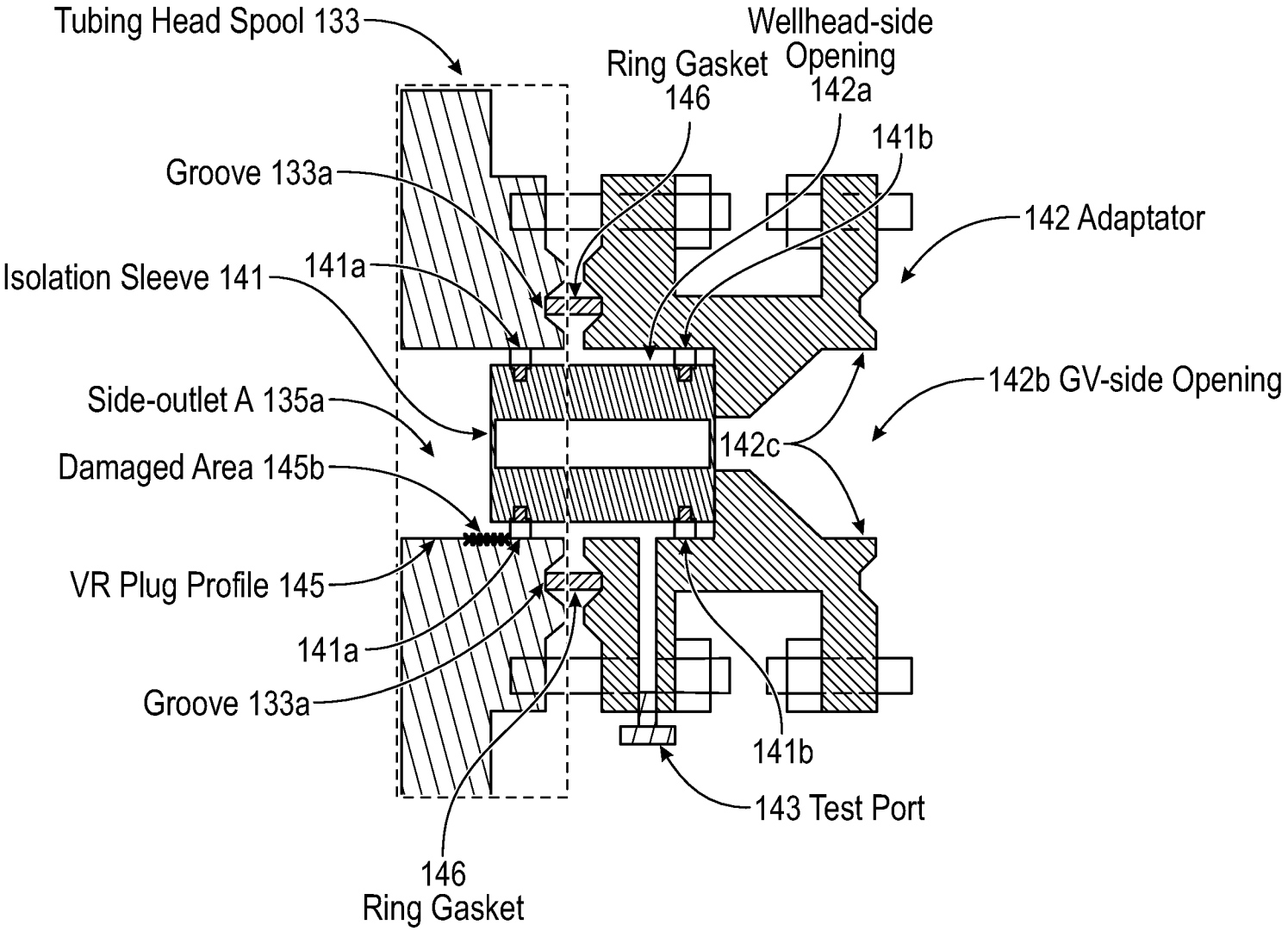

FIGS. 1E and 1F show schematic diagrams in accordance with one or more embodiments. In one or more embodiments, one or more of the modules and/or elements shown in FIGS. 1E and 1F may be omitted, repeated, and/or substituted. Accordingly, embodiments of the invention should not be considered limited to the specific arrangements of modules and/or elements shown in FIGS. 1E and 1F.

FIG. 1E illustrates an example side-view cross-section of the side-outlet adaptor assembly (140). FIG. 1F illustrates an example side-view cross-section of the side-outlet adaptor assembly (140) that is installed in the side-outlet A (135*a*) depicted in FIG. 1B above. As shown in FIGS. 1E and 1F, the side-outlet adaptor assembly (140) includes an isolation sleeve (141) (also shown as isolation sleeve top-view (141*c*)) and an adaptor (142) (also shown as adaptor top-view (142*d*)). The isolation sleeve (141) is a cylindrical hallow pipe which accommodates the pressure testing of the connection between the adaptor (142) and the wellhead-side-outlet A (135*a*), as illustrated in FIG. 1F. The isolation sleeve (141) is fitted with elastomer outer diameter seals for sealing the connection. The elastomer seal A (141*a*) is used to seal between the isolation sleeve (141) and the side-outlet A (135*a*). The elastomer seal B (141*b*) is used to seal between the isolation sleeve (141) and a wellhead-side opening (142*a*) of the adaptor (142). Elastomer seals are made of polymer and provides sealing within a wellhead component, such as on casing hanger sealing assembly or the isolation sleeve.

When installing the side-outlet adaptor assembly (140), the isolation sleeve (141) is first partially inserted into the side-outlet A (135*a*) of the wellhead tubing head spool (133) prior to installing the adaptor (142) to enclose the portion of the isolation sleeve (141) that remains outside of the side-outlet A (135*a*). As shown in FIG. 1F, the adaptor (142) is installed against the wellhead-side opening (142*a*) using the isolation sleeve (141) and a ring gasket (146) disposed in the groove (133*a*). In particular, the ring gasket (146) forms a seal between the groove (133*a*) and a corresponding groove on the adaptor (142) when the isolation sleeve (141) is received by the side-outlet A (135*a*) and the adaptor (142).

Once installed, the adaptor (142) accommodates a new gate valve (GV) to be installed on a GV-side opening (142*b*) of the adaptor (142). A test port (143) is provided on the wellhead-side opening (142) for performing a pressure test of the seal formed by the elastomer seal A (141*a*) and elastomer seal B (141*b*) so as to verify the air-tight connection between the adaptor (142) and the side-outlet A (135*a*). The GV-side opening (142*b*) of the adaptor (142) has a machined surface (142) that is a VR plug profile based on the API SPEC 6A standard to substitute the VR plug profile (145) on the side-outlet A (135*a*). In one or more embodiments, the side-outlet adaptor assembly (140) is installed onto the side-outlet A (135*a*) when the VR plug profile (145) is damaged. For example, the VR plug profile (145) may have a damaged area (145*b*) such that the side-outlet GV A (136*a*) cannot be successfully installed as depicted in FIG. 1B above.

Instead of the aforementioned new gate valve (GV), the installed side-outlet adaptor assembly (140) may alternatively allow a threaded VR plug to be inserted into the GV-side opening (142*b*) to function as mechanical barrier to isolated pressure coming from the wellhead annulus. The ability to insert the VR plug via the side-outlet adaptor assembly (140) facilitates pressure testing the gate valve to determine if it is defective, or replacing the gate valve if it is determined as being damaged. Without the ability to insert the VR plug via the side-outlet adaptor assembly (140) compromises wellhead integrity and complicates intervention solutions. In other words, using the side-outlet adaptor assembly (140) minimizes such risks. In one or more embodiments, the side-outlet adaptor assembly (140) is manufactured and pressure tested at a proper manufacturing facility before being deployed in the field.

Figure 2:
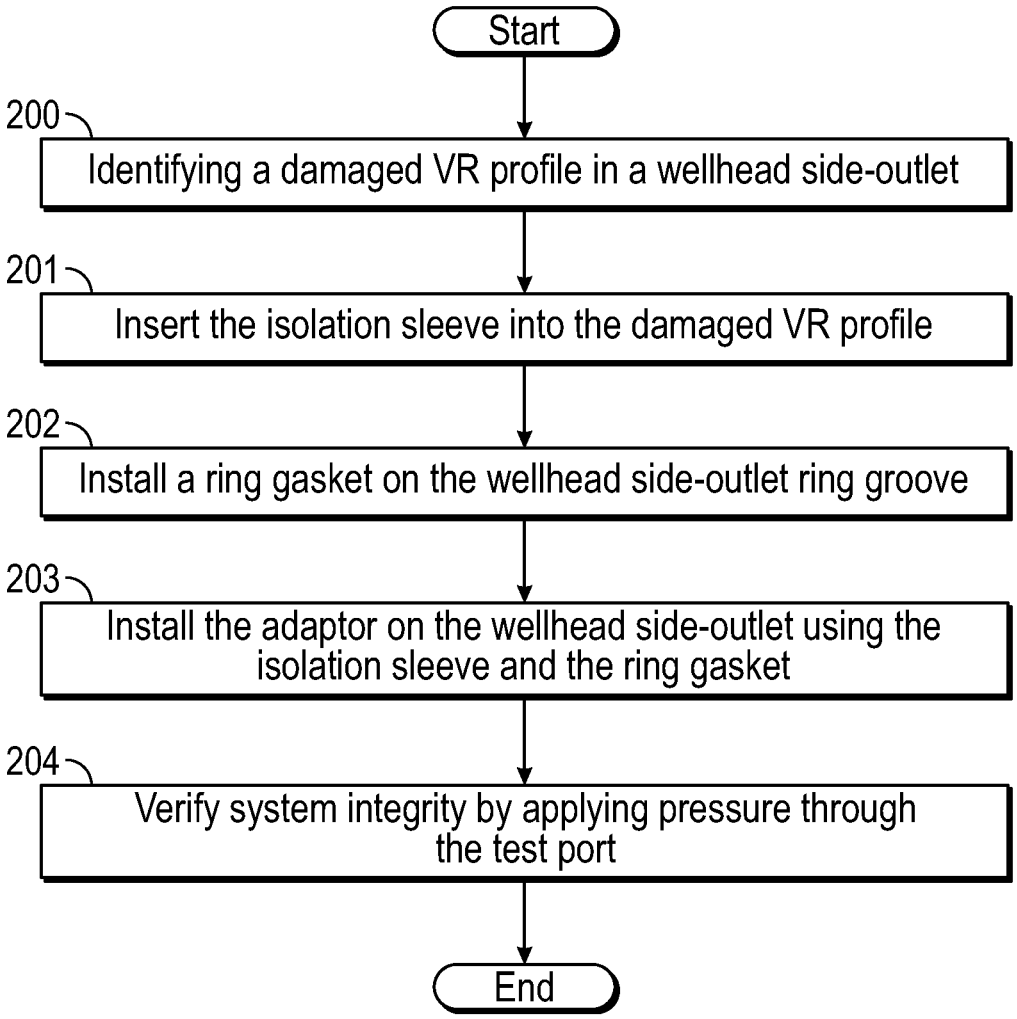
FIG. 2 shows a flowchart in accordance with one or more embodiments.

FIG. 2 shows a flowchart in accordance with one or more embodiments. One or more blocks in FIG. 2 may be performed using one or more components as described in FIGS. 1A-1F. While the various blocks in FIG. 2 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

The method flowchart described below utilizes the side-outlet adaptor assembly described above to seal the damaged VR plug profile on the wellhead as a more effective alternative to existing complex solutions and/or high risk operations to repair the damaged VR plug profile. In comparison, the installation method of the side-outlet adaptor assembly to repair the damaged VR plug profile is significantly simplified. To install the side-outlet adaptor assembly, the sleeve is inserted inside the wellhead-side-outlet and the adaptor is installed on the wellhead spool through the standard API flange make-up process. The side-outlet adaptor assembly may be designed and adapted to match any API connection on a wellhead-side-outlet.

Initially, in Block 200, a damaged VR plug profile is identified on a side-outlet of a wellhead. For example, the VR plug profile of the side-outlet may have a damaged area that prevents a gate valve to be properly installed onto the wellhead spools.

In Block 201, the isolation sleeve of the side-outlet adaptor assembly is inserted into the damaged VR plug profile.

In Block 202, a ring gasket is installed on the wellhead-side-outlet ring groove.

In Block 203, the adaptor is installed to the wellhead-side-outlet using the isolation sleeve and the ring gasket. In addition, a VR plug is threaded onto the VR plug profile of the adaptor.

In Block 204, the system integrity is confirmed by applying pressure through the test port of the adaptor to detect any air/gas leakage from the annulus to the exterior of the wellhead. Once the air/gas tightness is confirmed, the damaged VR plug profile is successfully substituted by the VR plug profile of the adaptor. Subsequently, the VR plug may be removed to properly install a gate value to continue proper operation of the wellhead.

Embodiments of the invention provide the following advantages: (i) allowing for restoring the VR plug functionality as a mechanical barrier without resorting to critical machining process to repair the damaged profile, (ii) eliminating quality control inspection on the repaired profile in the field by inspecting and testing the side-outlet adaptor assembly at the manufacturing facility, (iii) eliminating specialized solutions or services by combining widely available technology, such as API adaptors and elastomer seals.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed is:

1. A side-outlet adaptor assembly for repairing a side-outlet of a wellhead spool, comprising:

an isolation sleeve having a first portion adapted to be received by the side-outlet and a second portion adapted to be received by an adaptor;

the adaptor having a wellhead-side opening adapted to receive the isolation sleeve and a gate-valve-side (GV-side) opening adapted to receive a valve replacement (VR) plug; and a test port arranged on the adaptor for performing a pressure test of the side-outlet, wherein the side-outlet and the GV-side opening are on opposite sides of the adaptor when the isolation sleeve is installed to repair the side-outlet.

2. The side-outlet adaptor assembly of claim 1, wherein the isolation sleeve is fitted with a first elastomer outer diameter seal adapted to form a first seal against the side-outlet when the isolation sleeve is received by the side-outlet.

3. The side-outlet adaptor assembly of claim 2, wherein the isolation sleeve is further fitted with a second elastomer outer diameter seal adapted to form a second seal against the adaptor when the isolation sleeve is received by the adaptor.

4. The side-outlet adaptor assembly of claim 3, further comprising:

a ring gasket adapted to be installed on a ring groove on the wellhead spool surrounding the side-outlet, wherein the ring gasket forms a third seal between the ring groove and a corresponding groove on the adaptor when the isolation sleeve is received by the side-outlet and the adaptor.

5. The side-outlet adaptor assembly of claim 1, wherein the side-outlet comprises a first threaded VR plug profile.

6. The side-outlet adaptor assembly of claim 5, wherein the GV-side opening of the adaptor comprises a second threaded VR plug profile, and wherein the second threaded VR plug profile substitutes the first threaded VR plug profile when the isolation sleeve is received by the side-outlet and the adaptor.

7. The side-outlet adaptor assembly of claim 6, wherein the side-outlet further comprises a damaged area in the first threaded VR plug profile that prevents a proper installation of the VR plug onto the side-outlet, and wherein the second threaded VR plug profile substitutes the first threaded VR plug profile to receive the VR plug for the proper installation onto the adaptor.

8. A wellhead of a well, comprising:

a wellhead spool comprising a side-outlet that is damaged; and a side-outlet adaptor assembly for repairing the side-outlet, comprising:

an isolation sleeve having a first portion adapted to be received by the side-outlet and a second portion adapted to be received by an adaptor;

the adaptor having a wellhead-side opening adapted to receive the isolation sleeve and a gate-valve-side (GV-side) opening adapted to receive a valve replacement (VR) plug; and a test port arranged on the adaptor for performing a pressure test of the side-outlet, wherein the side-outlet and the GV-side opening are on opposite sides of the adaptor when the isolation sleeve is installed to repair the side-outlet.

9. The wellhead of claim 8, wherein the isolation sleeve is fitted with a first elastomer outer diameter seal adapted to form a first seal against the side-outlet when the isolation sleeve is received by the side-outlet.

10. The wellhead of claim 9, wherein the isolation sleeve is further fitted with a second elastomer outer diameter seal adapted to form a second seal against the adaptor when the isolation sleeve is received by the adaptor.

11. The wellhead of claim 10, the side-outlet adaptor assembly further comprising:

a ring gasket adapted to be installed on a ring groove on the wellhead spool surrounding the side-outlet, wherein the ring gasket forms a third seal between the ring groove and a corresponding groove on the adaptor when the isolation sleeve is received by the side-outlet and the adaptor.

12. The wellhead of claim 8, wherein the side-outlet comprises a first threaded VR plug profile.

13. The wellhead of claim 12, wherein the GV-side opening of the adaptor comprises a second threaded VR plug profile, and wherein the second threaded VR plug profile substitutes the first threaded VR plug profile when the isolation sleeve is received by the side-outlet and the adaptor.

14. The wellhead of claim 13, wherein the side-outlet further comprises a damaged area in the first threaded VR plug profile that prevents a proper installation of the VR plug onto the side-outlet, and wherein the second threaded VR plug profile substitutes the first threaded VR plug profile to receive the VR plug for the proper installation onto the adaptor.

15. A method for repairing a side-outlet of a wellhead, comprising:

identifying a damaged valve removal (VR) plug profile on the side-outlet of the wellhead;

inserting an isolation sleeve of a side-outlet adaptor assembly into the damaged VR plug profile;

installing a ring gasket on a ring groove surrounding the side-outlet;

installing an adaptor of the side-outlet adaptor assembly using the isolation sleeve and the ring gasket;

inserting a VR plug onto a VR plug profile of the adaptor; and confirming air/gas tightness of the side-outlet by applying pressure through a test port of the adaptor to detect any air/gas leakage from an annulus to outside of the wellhead, wherein the damaged VR plug profile is substituted by the VR plug profile of the adaptor, wherein the side-outlet and the GV-side opening are on opposite sides of the adaptor when the isolation sleeve is installed to repair the side-outlet.

* * * * *